US009724594B2

(12) United States Patent
Shigeta

(10) Patent No.: US 9,724,594 B2
(45) **Date of Patent: *Aug. 8, 2017**

(54) PACKING BOX OF PLAYING CARDS

(71) Applicant: ANGEL PLAYING CARDS CO., LTD., Osaka (JP)

(72) Inventor: Yasushi Shigeta, Osaka (JP)

(73) Assignee: Angel Playing Cards Co., Ltd., Shiga (JP)

( * ) Notice: Subject to any disclaimer, the term of this patent is extended or adjusted under 35 U.S.C. 154(b) by 686 days.

This patent is subject to a terminal disclaimer.

(21) Appl. No.: 13/958,407

(22) Filed: Aug. 2, 2013

(65) Prior Publication Data

US 2014/0033660 A1 Feb. 6, 2014

(30) Foreign Application Priority Data

Aug. 5, 2012 (JP) ..... 2012-182741

(51) Int. Cl.
*A63F 1/06* (2006.01)
*A63F 1/14* (2006.01)
(Continued)

(52) U.S. Cl.
CPC ..... *A63F 1/062* (2013.01); *A63F 1/14* (2013.01); *A63F 1/10* (2013.01); *A63F 1/12* (2013.01); *A63F 2009/242* (2013.01); *A63F 2009/2489* (2013.01); *A63F 2250/58* (2013.01); *B65D 75/54* (2013.01); *B65D 75/58* (2013.01);
(Continued)

(58) Field of Classification Search
CPC ..... A63F 1/062; A63F 2009/2489; A63F 2009/242; A63F 1/10; A63F 1/12; A63F 1/14; B65D 75/54; B65D 75/5405; B65D 75/541; B65D 75/5415; B65D 75/58;
(Continued)

(56) References Cited

U.S. PATENT DOCUMENTS 945,868 A * 1/1910 Sanguinette ..... B65D 5/5286 206/315.1
1,404,945 A * 1/1922 Epstein ..... A63F 1/06 206/315.1
(Continued)

FOREIGN PATENT DOCUMENTS

JP 2002172013 6/2002
JP 2002284151 10/2002
(Continued)

OTHER PUBLICATIONS

International Application No. PCT/JP2012/008036, International Search Report mailed Feb. 5, 2013.

*Primary Examiner* — Bryon Gehman
(74) *Attorney, Agent, or Firm* — Michael V. Solomita

(57) ABSTRACT

A packing box for packaging of playing cards has, in an assembled state, a shape of a rectangular parallelepiped with six faces including front and rear faces, right and left side faces, and top and bottom faces. The packing box includes cut lines in two locations at a predetermined interval in parallel with a longitudinal direction of the rectangular parallelepiped, and a central band in a portion defined by the cut lines provided in the two locations. The right and left side faces of the packing box can be removed along the cut lines such that side edges of the playing cards within the packing box are exposed.

6 Claims, 8 Drawing Sheets

(51) Int. Cl.

| | |
|---|---|
| *B65D 75/58* | (2006.01) |
| *B65D 75/54* | (2006.01) |
| *A63F 1/10* | (2006.01) |
| *A63F 1/12* | (2006.01) |
| *A63F 9/24* | (2006.01) |

(52) U.S. Cl.
CPC ..... *B65D 75/5805* (2013.01); *B65D 75/5827* (2013.01); *B65D 75/5833* (2013.01); *B65D 75/5838* (2013.01); *B65D 75/5844* (2013.01)

(58) Field of Classification Search
CPC ..... B65D 75/5805; B65D 75/5827; B65D 75/5833; B65D 75/5838; B65D 75/5844
USPC ..... 206/37–39, 39.1, 39.7, 315.1, 449, 451, 206/455, 459.5, 526, 555; 229/200, 203, 229/240–242
See application file for complete search history.

(56) References Cited

U.S. PATENT DOCUMENTS 1,848,764 A * 3/1932 Beyer ..... B65D 5/4204 206/39
2,141,752 A * 12/1938 Hoarle ..... B65D 5/6685 206/819
2,315,136 A * 3/1943 Platkin ..... A63F 1/06 206/315.1
2,430,707 A * 11/1947 Cahn ..... A63F 1/06 206/315.1
2,533,577 A * 12/1950 Godfrey ..... A63F 1/06 206/315.1
2,577,007 A * 12/1951 Dubilier ..... A63F 1/06 206/315.1
3,071,244 A * 1/1963 Doran ..... B65D 5/5495 206/273
3,286,830 A * 11/1966 Robb, Jr. ..... B65D 5/725 206/526
3,388,853 A * 6/1968 Matich, Jr. ..... G03G 15/0884 206/222
3,858,717 A * 1/1975 Peters ..... B65D 5/4216 206/459.5
4,111,297 A * 9/1978 Paulin ..... B65D 5/54 206/526
4,784,261 A * 11/1988 Kutchin ..... B65D 85/1072 206/256
2002/0153272 A1* 10/2002 Rapoza ..... B65D 5/4212 206/449
2003/0024841 A1* 2/2003 Murphy ..... B65D 5/00 206/459.5
2006/0191426 A1* 8/2006 Timmerman ..... B26D 5/32 101/24
2007/0120321 A1* 5/2007 Fruchtman ..... A63F 1/06 273/148 A
2010/0155292 A1* 6/2010 Fell ..... B65B 11/48 206/738
2010/0314834 A1 12/2010 Shigeta
2010/0327525 A1 12/2010 Shigeta
2011/0130185 A1 6/2011 Walker
2012/0318703 A1* 12/2012 Fell ..... B65B 11/48 206/526

FOREIGN PATENT DOCUMENTS

| | | |
|---|---|---|
| JP | 2004035095 | 2/2004 |
| JP | 2006335384 | 12/2006 |
| JP | 2011024603 | 2/2011 |
| JP | 3167277 | 4/2011 |
| WO | 0071438 | 11/2000 |
| WO | 2007062701 | 6/2007 |

* cited by examiner (a)

(b)

PACKING BOX OF PLAYING CARDS

TECHNICAL FIELD

The present invention relates to playing cards used in card games, and particularly, to shuffled playing cards packed as an individual pack after being shuffled in a random manner, a packing box for packing an individual set of playing cards.

BACKGROUND

In poker, baccarat, bridge, blackjack, and other card games, a dealer sets one or more decks of playing cards in a card shooter or the like, and deals cards to game players by shooting the cards one by one out of the card shooter or the like. In so doing, to ensure fairness of the games, the cards need to be dealt at random. Therefore, a game host has to sufficiently shuffle the playing cards randomly in order to ensure a random order of arrangement of the playing cards before the playing cards are set in the card shooter.

It should be noted that a conventional card shuffling device for shuffling cards is disclosed in, for example, WO 2009/069708.

SUMMARY OF INVENTION

The shuffled playing cards used in various card games such as poker, baccarat, bridge or blackjack include, ordinary, 416 cards if eight decks of cards are used. Eight decks of playing cards have 416 cards, and the height thereof is approximately 125 mm. Therefore, when the dealer tries to set such 416 playing cards in a card shooter or the like at one time, it may be impossible to house the cards neatly since they get misaligned, which is a problem and hampers the efficient operation of the games. There is also a problem of possible cheating such as the insertion/removal or switching of cards when the cards are housed in a card shooter.

The present invention has been made in view of the above problems, and aims to provide a packing box of playing cards and shuffled playing cards with which the game host can readily set playing cards in a card shooter or the like prior to a game, and that can eliminate the possibility of cheating.

To achieve the above object, the present invention provides a packing box of playing cards that has, in an assembled state, a shape of a rectangular parallelepiped with six faces that are front and rear faces, right and left side faces, and top and bottom faces, and encases the playing cards, the packing box including zippers or cutoff units in two locations at a predetermined interval, the zippers or the cutoff units including cut lines in parallel with a longitudinal direction of the rectangular parallelepiped shape, and a central band in a central portion defined by the zippers or the cutoff units provided in the two locations, wherein the right and left side faces of the packing box can be removed by removing the zippers or the cutoff units such that side faces of the playing cards are exposed.

To achieve the above object, the present invention provides shuffled playing cards that are housed in a packing box and encased therein in a shuffled state, and sealed, the shuffled playing cards containing a number of cards that can form a predetermined number of decks, the packing box being a packing box that has a shape of a rectangular parallelepiped with six faces that are front and rear faces, right and left side faces, and top and bottom faces, and that has zippers or cutoff units in two locations at a predetermined interval, the zippers or the cutoff units including zipper lines or cut lines in parallel with a longitudinal direction of the rectangular parallelepiped shape, and a central band provided in a portion defined by the zippers or the cutoff units provided in the two locations, wherein the right and left side faces of the packing box can be removed by removing the zippers or the cutoff units along the zipper lines or the cut lines such that side faces of the playing cards are exposed.

With the present invention, it is possible to achieve an easier handling of a predetermined number of decks of shuffled playing cards to be used in card games so that the cards can be set to a shoe in a safe and reliable manner, thereby improving the operability of games at casinos, reducing the operation cost and improving safety.

DETAILED DESCRIPTION OF EMBODIMENTS

Figure 1:
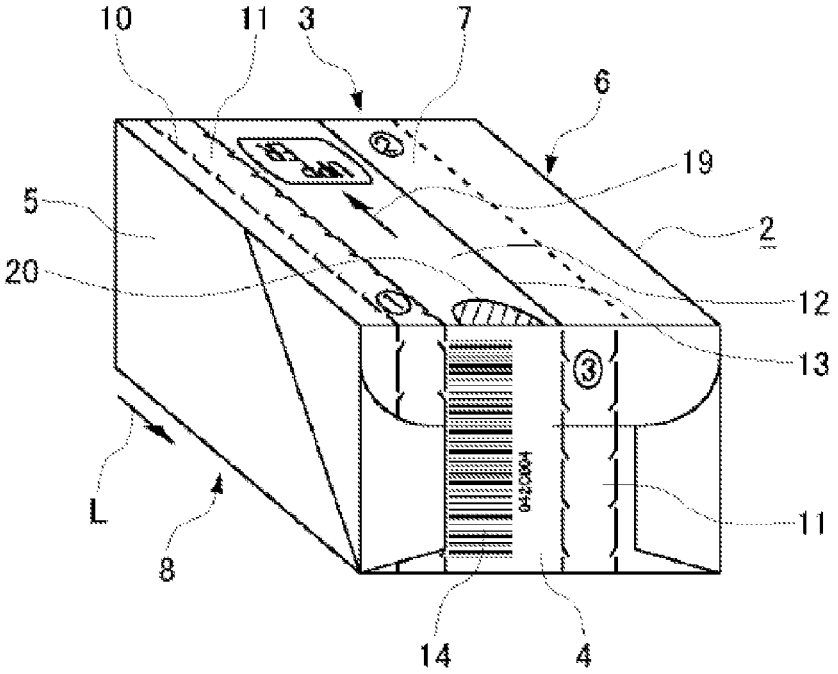
FIG. 1(*a*) is a perspective view of a packing box packing shuffled playing cards according to Embodiment 1 of the present invention, and FIG. 1(*b*) is a perspective view showing a state in which the packing box packing the shuffled playing cards is partially broken to show a portion of the cards.
Figure 1:
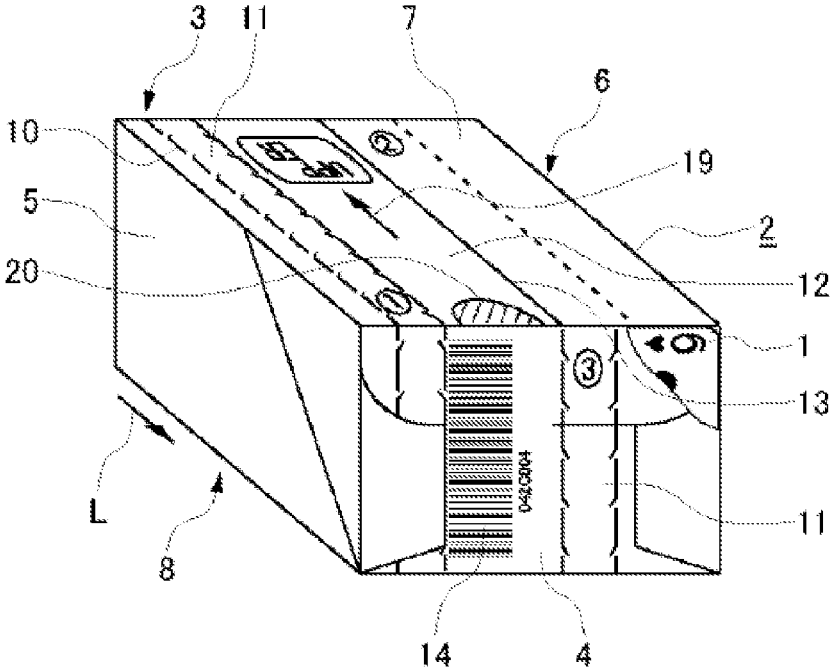

Embodiment 1 of the present invention will be described with reference to the attached drawings. FIGS. 1(*a*) and 1(*b*) are perspective views each illustrating a packing box of Embodiment 1 packing shuffled playing cards. A packing box 2 of shuffled playing cards 1 has the shape of a rectangular parallelepiped with six faces, namely, a front face 3, a rear face 4, a left side face 5, a right side face 6, a top face 7 and a bottom face 8 so as to encase the shuffled playing cards 1 in an assembled state. The packing box 2 includes zippers 11 provided in two locations at a predetermined interval, each of which includes zipper-shaped cut lines 10 arranged in parallel with a longitudinal direction (an arrow L) of the rectangular parallelepiped shape, and has a central band 12 in the central portion defined by the zippers 11 provided in the two locations.

The central band 12 is colored so as to be readily distinguishable from the other portions. As described in detail later, a configuration is achieved in which by removing the two zippers 11 along the cut lines 10 formed by zipper lines or a straight slit 13, the left and right side faces 5 and 6 of the packing box 2 are removed such that the side edges of the shuffled playing cards 1 would be exposed. Note that it is possible to configure the zipper 11 as a cutoff unit to enable a cut along the cut line 10 with a thread or the like, as a variation.

Figure 2:
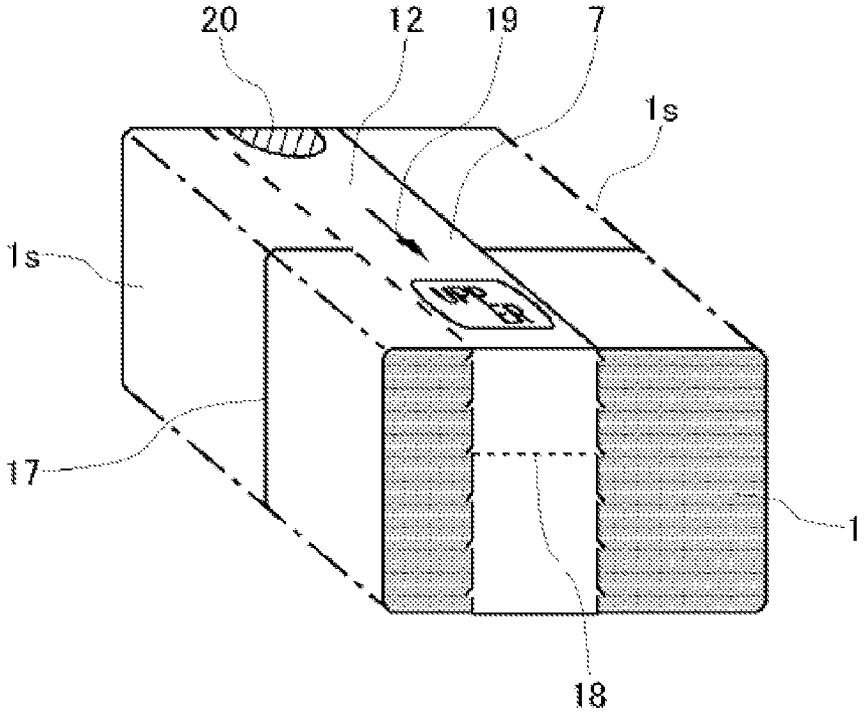
FIG. 2 is a perspective view showing a state in which the side faces of the shuffled playing cards of Embodiment 1 of the present invention are exposed.

FIG. 2 is a perspective view showing a state in which side faces is of the shuffled playing cards 1 are exposed. The shuffled playing cards 1 are made up of a predetermined number of decks, and for example, in the case of eight decks of shuffled playing cards 1, there are 416 cards. The shuffled playing cards 1 are shuffled by a conventional card shuffling device in advance in order for them to be arranged in a random order, housed in the packing box 2 that encases the shuffled playing cards 1, sealed with a sealing material or a shrink packaging material, and then supplied to casinos or the like. Note that FIG. 1 shows a state in which the packing boxes 2 housing the shuffled playing cards 1 each have attached thereon a bar code 14 (also serving as a seal), the bar codes 14 having mutually different ID codes (identification codes). The sets of shuffled playing cards 1 have mutually different card arrangement orders due to shuffling, and thus, each set is unique. Therefore, in order to identify each set, an ID code is used in the form of a bar code 14 or a QR (quick response) code. The ID code uniquely identifies each set of shuffled playing cards. In an exemplary embodiment, an RFID (or a RF-tag) may be attached as the ID code.

Figure 5:
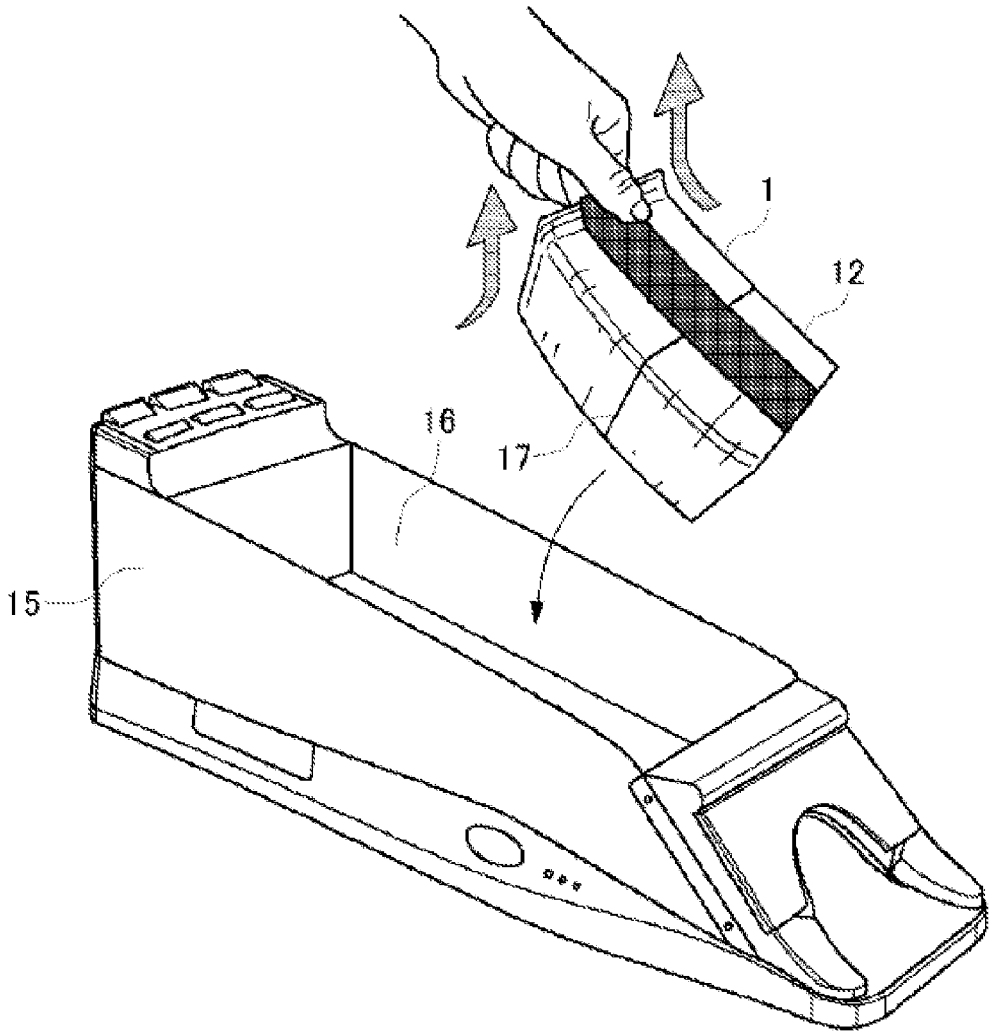
FIG. 5 is a schematic diagram showing a state in which the shuffled playing cards are housed in a shooter.

Next, with reference to FIGS. 5 and 6, a method of housing the shuffled playing cards 1 in a shooter 15 that is used in a casino or the like will be described. When the shuffled playing cards 1 are housed in the card shooter 15 to be used in a casino or the like, the zippers 11 are removed along the cut lines 10 such as zipper lines and then the left and right side faces 5 and 6 of the packing box 2 are removed as described above, thereby exposing the side edges is of the shuffled playing cards 1 as shown in FIGS. 2 and 5. Thereafter, the shuffled playing cards 1 are held at a corner portion of the central band 12 and lifted, and then housed in a card housing portion 16 of the card shooter 15 for card games, as shown in FIG. 5. The procedure for this will be described in detail below.

In the packing box 2 where the shuffled playing cards 1 are housed, circled numbers 1 to 3 indicating the procedural order for removing the zippers 11 are printed on the zippers 11, as shown in FIG. 1. In accordance with this order, as shown in FIG. 6-1, the portion on the left of a zipper 11 is removed first to remove the left side face 5 of the packing box 2, thereby exposing one side edge of each of the shuffled playing cards 1 within the packing box 2 (a first side edge exposure step). This first side edge exposure step may further include a card cut step of inserting a cut card 17, which is used at a casino in order to stop the use of the shuffled playing cards 1 in the middle of games after that game as appropriate, into the shuffled playing cards 1. The card cut step of inserting a cut card 17 into the shuffled playing cards 1 allows for: 1) dividing of the shuffled playing cards 1 into two parts by the cut card (the first half and second half) and then 2) exchanging positions of the two halves (the first half should be the backward position to the cut card and the second half should be in front position). This step is so called normally the "cut" in a card game. After the first "cut", the cut card may again be inserted into the shuffled playing cards 1 at casinos in order to stop the use of the shuffled playing cards 1 going forward or after a few games after the cut card appears.

Figure 4:
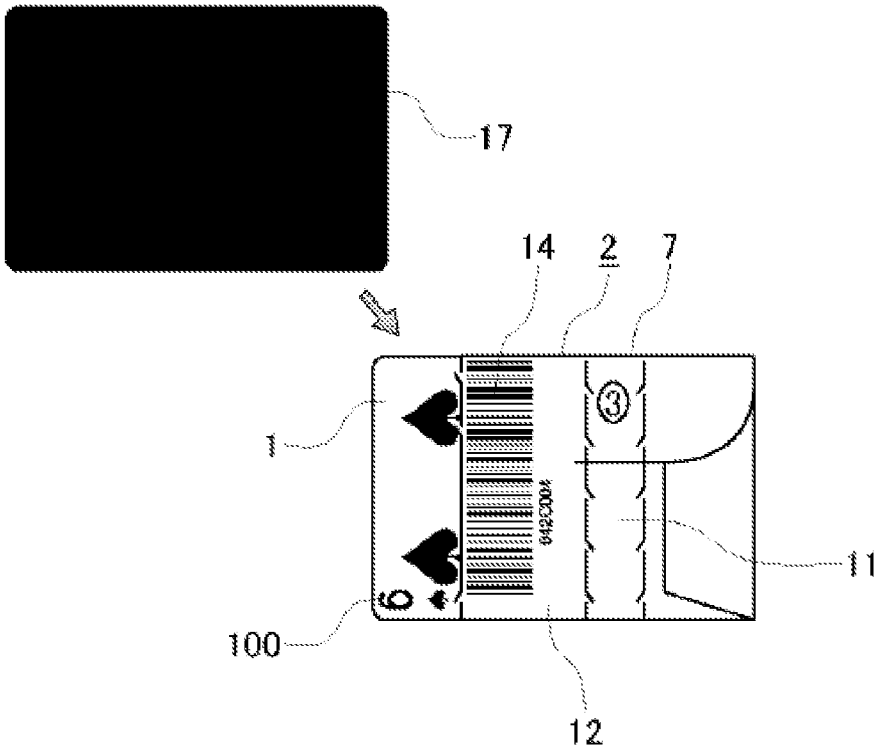
FIG. 4 is a diagram showing a state in which a cut card is inserted in the shuffled playing cards.

FIG. 4 illustrates that card cut step. Since a player (customer) of the casino is requested to insert the cut card 17 into the shuffled playing cards 1 as the "cut", there may be cheating if an index 100 of a shuffled playing card 1 at the place of insertion is seen when inserting the cut card 17. Therefore, the shuffled playing cards 1 may be housed in the packing box 2 in advance such that when the cut card 17 is inserted, the side on which the index of the shuffled playing cards 1 is not printed (the upper left portion of the upper face 7) is on top (see FIG. 4). The procedural order for removing the zippers 11 may be indicated with the circled numbers printed on the zippers 11 such that the cut card 17 can be inserted from the left side edges is where the shuffled playing cards 1 are exposed.

Figure 3:
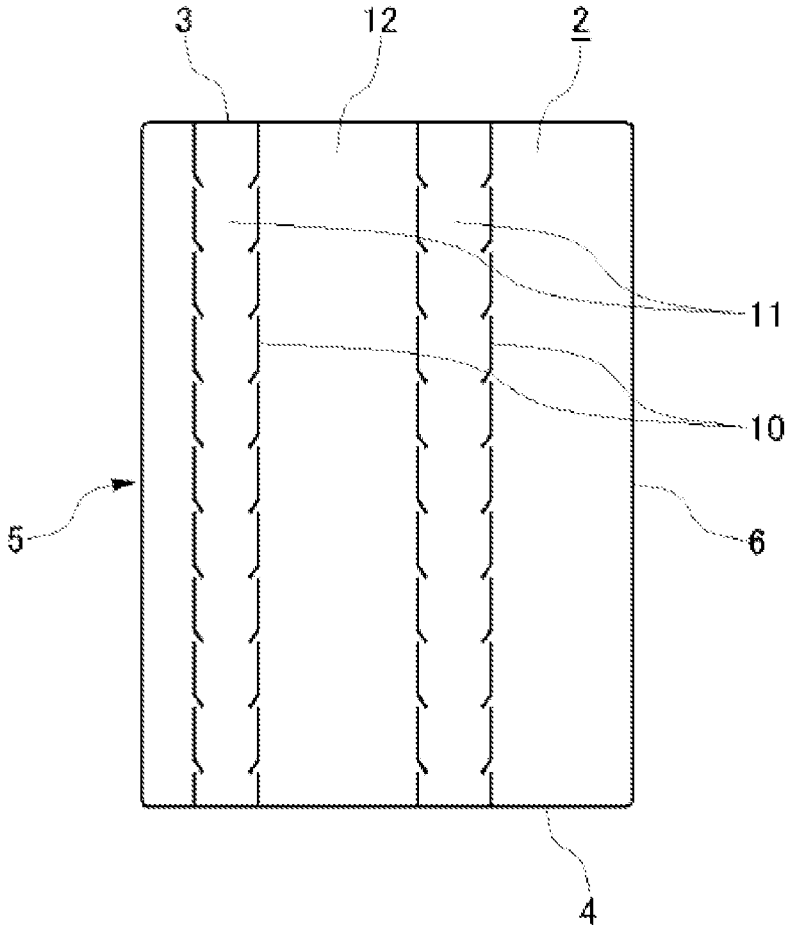
FIG. 3 is a bottom view of a packing box of the shuffled playing cards according to an exemplary embodiment of the present invention.
Figure 6:
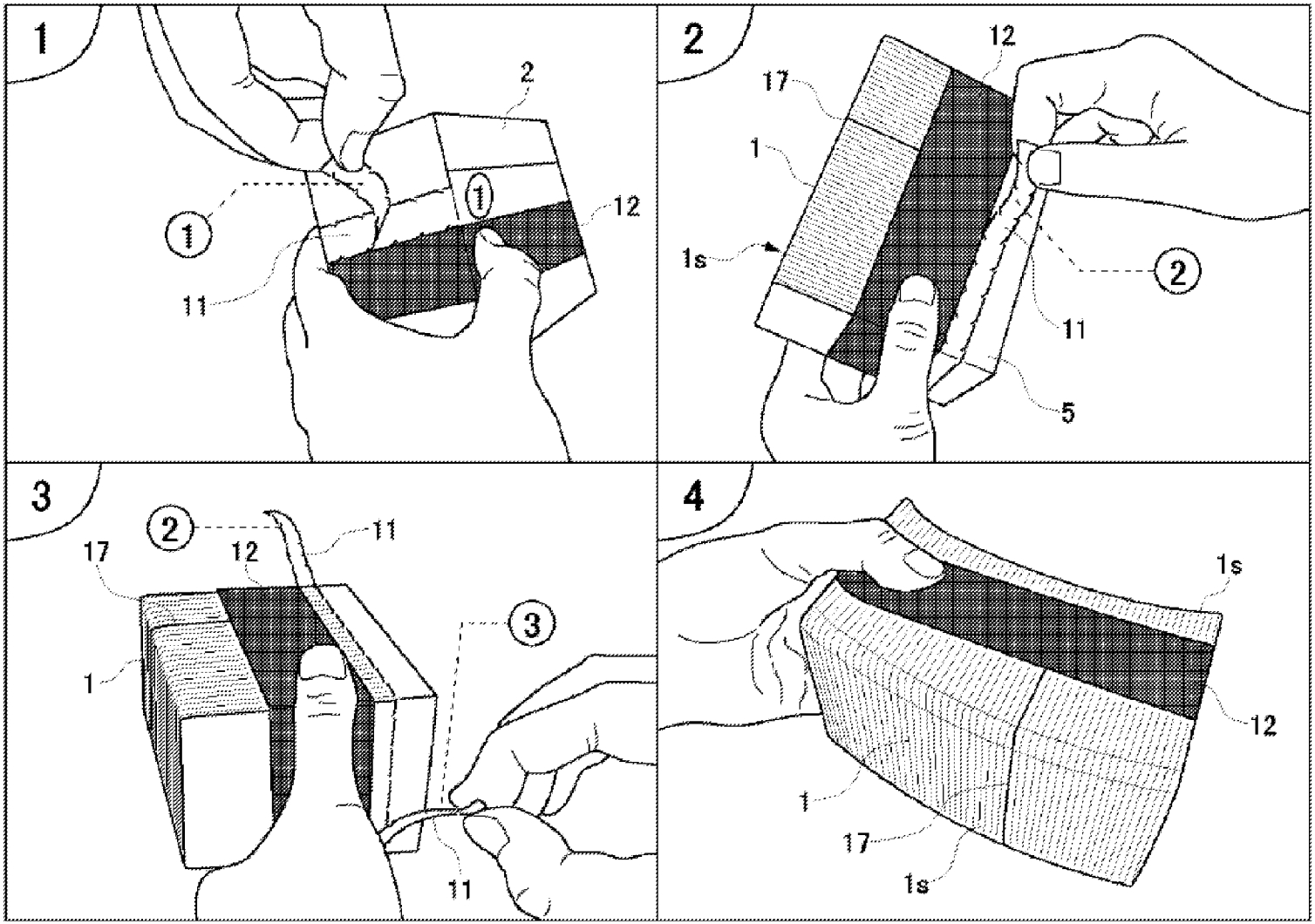
FIG. 6 is a diagram illustrating a procedure according to an exemplary embodiment of the present invention for housing the shuffled playing cards in a shooter.

Next, as illustrated in FIGS. 6-2 and 6-3, the other zipper 11 of the packing box 2 on the other side is removed in the order indicated by the circled numbers 2 and 3, and the right side face 6 of the packing box 2 is removed to expose the other side edges of the shuffled playing cards 1 within the packing box 2, thereby achieving a state in which the shuffled playing cards 1 are wrapped only with the central band 12 (a second side edge exposure step) (see FIG. 2). Next, as illustrated in FIG. 6-4, the rear corner of the central band 12 is held to lift together the shuffled playing cards 1 and the central band 12 (a lifting step). While the shuffled playing cards 1 and the central band 12 are lifted together, the shuffled playing cards 1 and the central band 12 are housed in the card housing portion 16 of the card shooter 15, as shown in FIG. 5 (a housing step). Next, the central band 12 is torn at a portion thereof (e.g., a break line 18) to remove the central band 12 from the card housing portion 16, thereby completing the housing with only the shuffled playing cards 1 left in the card housing portion 16 (a housing completion step). Note that as illustrated in FIG. 6-4, the bar code 14, or other form of ID code, remains in the central band 12. Since the bar code 14 or other form of ID code remains in the central band 12, it is advantageous to retain the central band 12 after removal without discarding the same, and to dispose of or the like the shuffled playing cards 1 after the use thereof in the game by putting the shuffled playing cards 1 in a carton bag for disposal, with the corresponding central band 12 including the bar code 14 or other form of ID code attached thereto, so as to manage the disposal of each set of shuffled playing cards 1 while maintaining the connection with the housing of the cards 1 in the card shooter 15 with a computer or the like, by reading the bar code 14 or other form of ID code with a reader (not shown in the drawings).

In Embodiment 1, the top face 7 of the packing box 2 has a marking (UPPER) indicating that it is the top face, and an arrow 19 indicating the orientation of the shuffled playing cards 1 when inserted in the card housing portion 16 (indicating the front/rear of the shuffled playing cards 1), making it possible to house the shuffled playing cards 1 in the card shooter 15 in the proper orientation without fail. Normally, when housed in the card shooter 15, the shuffled playing cards 1 are housed such that their rear faces with the pattern thereon are in front. In addition, a sign (for example, a mark 20) that indicates the place where the central band 12 is to be held and lifted is printed on the central band 12 of the packing box 2, and thus, the place for lifting can be readily found.

The shuffled playing cards for use in table card games, the housing box of the shuffled playing cards and the method of housing the same in a card shooter of the present invention enable the easy handling of a plurality of decks of shuffled playing cards and the proper housing of the shuffled playing cards in a card shooter, and thus, is useful for table card games held in casinos or the like.

Figure 7:
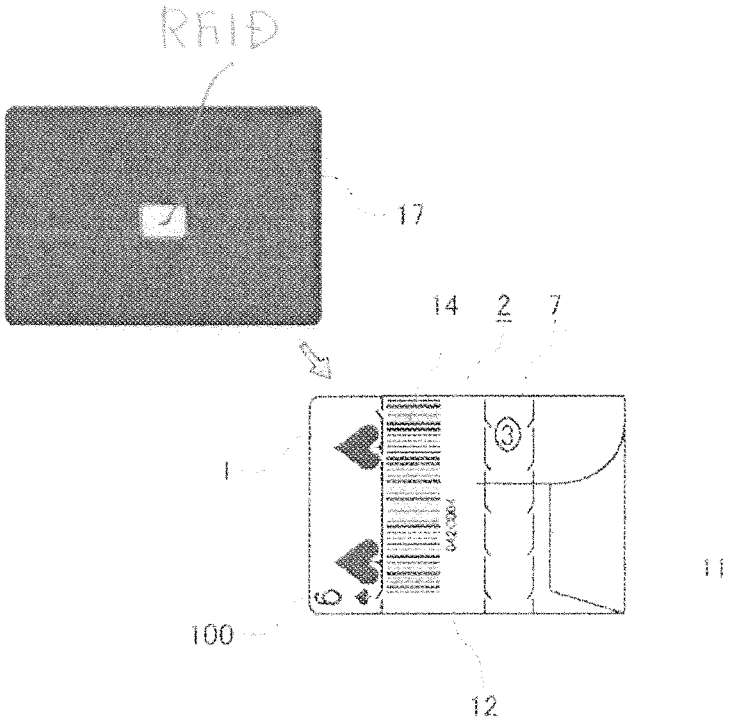
FIG. 7 shows a cut card being inserted into a package of shuffled playing cards according to an exemplary embodiment of the present invention.

As shown in FIG. 7, an RFID (or a RF-tag) may be attached as the ID code to the cut card 17 instead of attaching an RFID (or a RF-tag) to the packing box 2. In this case, the cut card 17 may be inserted into the shuffled playing cards 1 when they are packaged in the factory. This is advantageous in that it obviates the need for casinos to prepare the cut card 17 for the "cut". The cut card 17 is inserted at the left side or right side of the shuffled playing cards 1 in this case and the player (customer) or dealer of the casino may easily find and pick the cut card 17 in the package box 2. In this case the RFID (or a RF-tag) may not be attached to the package box 2 but the ID code may still be easily read from the RFID on or in the cut card 17 and the ID code uniquely identifies each set of shuffled playing cards.

Figure 8:
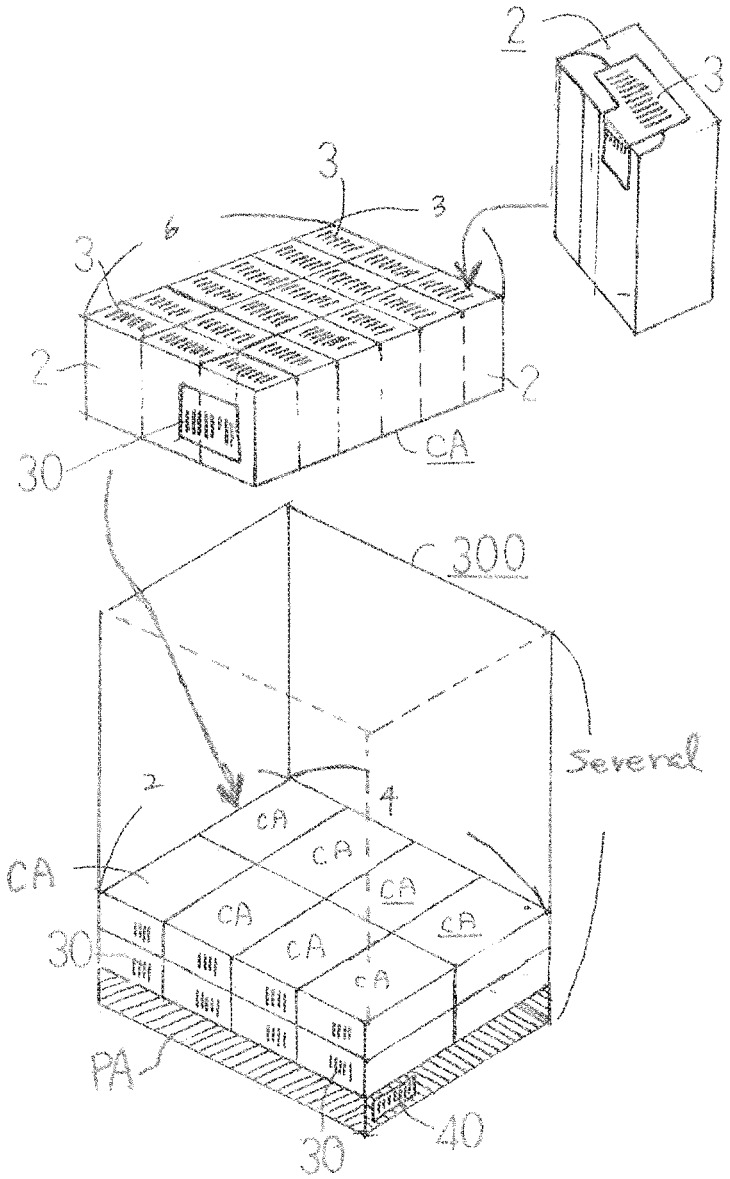
FIG. 8 are perspective views of a package of shuffled playing cards, a carton containing multiple packages of shuffled playing cards and a container containing multiple cartons according to an exemplary embodiment of the present invention.

According to an exemplary embodiment of the invention, multiple packing boxes 2 of shuffled playing cards are contained in a carton CA and multiple cartons CA are contained in a container 300 disposed on a pallet PA. As shown in FIG. 8, a carton ID including an RFID and a carton barcode 30 are attached to the each carton CA, and a container ID including an RFID and a container barcode 40 are attached to the container 300, and each carton ID and the container ID provides all information related to the ID codes of the packaging boxes 2 of shuffled playing cards contained in the carton CA or the container 300. The carton IDs may be registered in a database and associated with the ID codes of the packaging boxes 2 of shuffled playing cards contained in the carton CA and the container ID may be registered in a database and associated with the carton IDs of the cartons CA contained in the container 300 and also associated with all of the packaging boxes 2 of shuffled playing cards contained in the container 300. The carton ID or the container ID may be used to register all of the ID codes of the packaging boxes 2 upon delivery to a casino.

Now that the preferred embodiments of the present invention have been shown and described in detail, various modifications and improvements thereon will become readily apparent to those skilled in the art. Accordingly, the spirit and scope of the present invention is to be construed broadly and not limited by the foregoing specification.

What is claimed is:

1. A package housing a set of playing cards, the package having, in an assembled state, a shape of a rectangular parallelepiped with six faces including front and rear faces, right and left side faces, and top and bottom faces, the package comprising:

at least one cut line in parallel with a longitudinal direction of the package shape of the rectangular parallelepiped, wherein tearing of the package along the at least one cut line permits the removal of one of the left or right side faces of the package from a remaining portion of the package and the exposure of side edges of the playing cards within the package;

and a marking showing a first place in an order of steps for removing one of the left or right side faces of the package so that the remaining portion of the package includes a code that indicates a unique identification (ID) for the set of playing cards.

2. The package according to claim 1, wherein the top face has a marking indicating it to be a top surface, or a marking indicating orientation of the playing cards to a front or a rear of the package.

3. The package according to claim 1, further comprising markings showing an order of steps for removing the package from the playing cards.

4. The package according to claim 1, wherein the code comprises at least one of a bar code or RFID that indicates a different ID for each set of playing cards.

5. The package according to claim 1, wherein the at least one cut line comprises two cut lines.

6. The package according to claim 5, wherein tearing of the package along one of the two cut lines permits removal of the left side face of the package and tearing of the package along the other of the two cut lines permits removal of the right side face of the package.

* * * * *